United States Patent [19]

Wanke

[11] 4,342,156

[45] Aug. 3, 1982

[54] CYLINDER DRYER WITH BOUNDARY LAYER TURBULENCE

[76] Inventor: Wilhelm Wanke, Donauschwabenstrasse 47, 7920 Heidenheim, Fed. Rep. of Germany

[21] Appl. No.: 148,332

[22] Filed: May 9, 1980

[30] Foreign Application Priority Data

May 11, 1979 [DE] Fed. Rep. of Germany ..... 2918985

[51] Int. Cl.[3] ..... F26B 3/24

[52] U.S. Cl. ..... 34/41; 34/117; 34/120; 162/289; 162/375

[58] Field of Search ..... 34/117, 122, 120, 23, 34/41; 162/289, 375

[56] References Cited

U.S. PATENT DOCUMENTS 2,376,502 5/1945 Overton ..... 34/120
3,504,443 4/1970 Gustafsson ..... 34/117

FOREIGN PATENT DOCUMENTS 659771 7/1929 France ..... 34/120
1199229 7/1970 United Kingdom .
1255920 12/1971 United Kingdom .

*Primary Examiner*—Larry I. Schwartz
*Attorney, Agent, or Firm*—Benoit Law Corporation

[57] ABSTRACT

Methods and apparatus for drying a web of material running between a drying cylinder and a traveling covering cloth avoid the formation of air boundary layers which would impede heat exchange with respect to, and humidity removal from, the traveling web. In particular, these methods and apparatus avoid excessive wear of the covering cloth by locating a baffleplate at a distance from the covering cloth within a domain of the boundary layer, and promote a heat exchange and humidity removal through turbulence by impacting air from the boundary layer against a front surface of the baffleplate at a distance from the covering cloth, causing an exchange of air in the boundary layer and in meshes of the covering cloth. Effects of non-uniform humidity profiles are avoided by providing the front surface of the baffleplate with a varying configuration across the covering cloth.

14 Claims, 5 Drawing Figures

CYLINDER DRYER WITH BOUNDARY LAYER TURBULENCE

BACKGROUND OF THE INVENTION

1. Field of the Invention

The subject invention relates to the field of heat exchange and humidity removal and, more specifically, to dryers and drying, including cylinder dryers for paper and cardboard manufacture in which the paper, cardboard or other web to be dried runs between the shell of the drying cylinder and a supporting or covering cloth.

2. Disclosure Statement

In the manufacture of paper, carboard and the like, the efficiency of the corresponding machinery has in the past been progressively increased; a trend which represents also a goal for the future. Infortunately, however, the field of contact drying with steam-heated cylinder dryers has scored the lowest progress, even though that area, in terms of installations, traditionally represents the largest part of paper and cardboard machinery. The prevailing low efficiency is thus particularly significant as it determines the capacity of the entire installation and causes disagreeably high production costs.

A certain increase in drying efficiency has been accomplished by the development of cylinder dryers having a concurrently traveling web of felt or screenlike structure. Drying efficiency was also increased at a smaller scale through installation of strips insice the dryer cylinders for stirring up the laminar condensate film, which forms at the cylinder inside wall at speeds in excess of about 400 meters per minute, and for increasing thereby the heat transfer at the cylinder inside wall. In such arrangement, the transverse humidity profile of the web to be dried may somewhat be corrected over the width of the machine through an altering number of inner strips. The effect of such inner strips is, however, not very high, having its cause in the fact that the heat transfer in the cylinder is not the determining parameter for a limitation of the drying process. Rather, the determining factor is the capacity for the removal to the outside of the humidity being evaporated from the web to be dried. As is well known, drying with cylinders in series drying stations takes place in such a manner that the web to be dried runs over part of the circumference of the drying cylinder in heat-transfer contact relationship, and thereafter in a free span to the next drying cylinder, and that such sequence is repeated from drying cylinder to drying cylinder. A large part of the humidity to be evaporated is removed to the environmental air between the particular drying cylinders.

As long as the web to be dried runs over part of the circumference of each drying cylinder, it is most often pressed against the drying cylinder by the supporting fabric or covering cloth, for an increase of the heat transfer from the drying cylinder to the web to be dried. In the course of the particular circumferential cylinder part, the web is heated and the humidity removed.

The latter, however, is only possible to an extent until the outer border layer of air, which is in a laminar or near-laminar state, is saturated with evaporated humidity. In this manner, the achievable capacity of contact drying is very significantly reduced.

From U.S. Pat. No. 3,504,443 it is known to arrange on the outside of the felt or covering cloth a resilient body pressed thereagainst in order to break the border layer of air. In practice, this imposes considerable wear and tear on the traveling covering cloth. In another embodiment, a doctor blade acts as a knife in cutting off part of the border layer and brings about a thinning thereof. In other words, the border layer laden with humidity is "shaved off." A drawback of that technique is, however, that the air located in the meshes or interstices of the covering cloth or structure is not affected thereby, but continues to remain in the meshes to impede an efficient humidity removal. The cited reference thus proposes a use of auxiliary air jets which require special equipment and consume considerable energy.

SUMMARY OF THE INVENTION

It is a general object of the invention to overcome the above mentioned disadvantages and meet the needs mentioned or implied herein.

It is a related object of the invention to provide improved paper and cardboard manufacturing methods and machinery, and improved drying processes and equipment in general and, in particular, to provide improved ways and means for increasing the drying capacity of paper and cardboard manufacturing methods and machinery and of drying processes and equipment.

The invention meets these objects and broadly resides in methods and apparatus for drying a web of material running between a drying cylinder and a traveling covering cloth tending to form an air boundary layer impeding heat exchange and humidity removal. The invention resides more specifically in a combination of steps of, or means for, avoiding excessive wear of the covering cloth by locating a baffleplate at a distance from the covering cloth within a domain of the bounary layer, and promoting a heat exchange and humidity removal through turbulence by impacting air from the boundary layer against a front surface of the baffleplate at a distance from the covering cloth, causing an exchange of air in the bounary layer and in meshes of the covering cloth, and providing the front surface of the baffleplate with a varying configuration across the covering cloth.

BRIEF DESCRIPTION OF THE DRAWINGS

The invention will become more readily apparent from the following detailed description of preferred embodiments thereof, illustrated by way of example in the accompanying drawings in which like reference numerals designate like or functionally equivalent parts, and in which.

DESCRIPTION OF PREFERRED EMBODIMENTS

Figure 1:
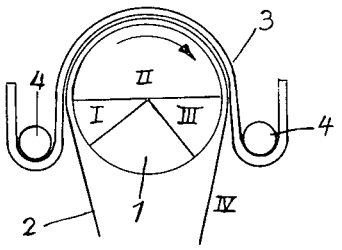
FIG. 1 is a side view of a conventional drying cylinder arrangement.

FIG. 1 diagrammatically illustrates the principle of a conventional cylinder dryer used in a series-drying arrangement. The web 2 to be dried, such as a strip of paper, carboard or other sheet material, runs over the drying cylinder 1 and is covered by a supporting web or covering cloth 3 which is guided over rollers 4. The course of the web to be dried is schematically divided into regions I, II, III and IV to facilitate explanation of the drying process.

Figure 2:
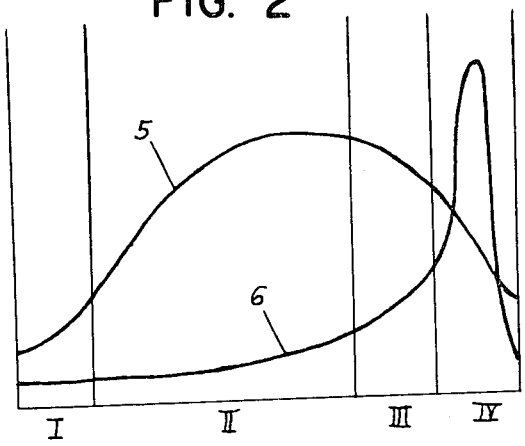
FIG. 2 is a graph illustrating operation of drying cylinder arrangements according to the state of the art.

In FIG. 2 the operation of the drying process along regions I, II, III and IV according to FIG. 1 is illustrated with reference to state of the art techniques. The web temperature 5 deviates widely from the evaporation rate 6, especially in region II, thereby signifying a throttling of the maximum drying capacity through saturation of the air boundary layer and accumulation of heat. With additional external turbulence-producing baffle strips 7, the evaporation rate 6, according to the invention, is, however, very significantly increased, especially in region II. In absolute terms, this rate of increase is dependent on the particular conditions of the drying installation and may reach values higher than twice an initial value without added turbulence.

Figure 3:
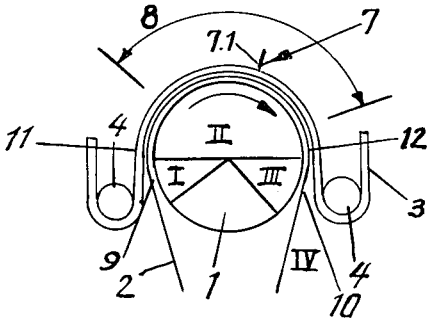
FIG. 3 is a side view of a drying cylinder arrangement with baffleplate according to an embodiment of the invention.

As seen in FIG. 3, excessive wear of the covering cloth 3 is avoided by locating a baffleplate or strip 7 or a leading edge of the baffleplate spaced or at a distance from the covering cloth, but within the domain of the air boundary layer external of, or above, the covering cloth.

Further according to the subject invention, heat exchange and humidity removal are promoted through turbulence by impacting air from the boundary layer against a front surface 7.1 of the baffleplate at a distance from the covering cloth, thereby causing an exchange of air in the bounary layer and in interstices or meshes of the covering cloth 3.

According to a preferred embodiment of the invention, one or more stationary turbulence-causing strips or baffleplates 7, having one or more air impact or front surfaces, are positioned over the outer periphery of the drying cylinder at a small distance therefrom or, more specifically, from the web 2 and covexing cloth 3 running thereon, at a location where the saturation of the air boundary layer materially reduces the drying capacity of the equipment.

The strips or baffleplates 7 thus influence the drying capacity determining parameter, namely the rate of humidity removal from the web 2 to be dried, very positively. In particular, these strips act as air impactors, effecting a turbulent air flow and/or whirling up of air in the boundary layer. This brings about a partial to total exchange of that air layer, resulting in a significant capacity increase of the drying process. Through the whirling up of air in the boundary layer by the impacting of air therein, air in the meshes of the covering cloth or supporting web is also exchanged.

As indicated in FIG. 3, the baffleplate 7 or front surface 7.1 is preferably located within an angular range or section 8. In particular, the front surface 7.1 according to an embodiment of the invention is located within an angular range extending from 45° after the forward end of the area of contact of the running web and the drying cylinder (tangent of the cylinder) to 30° ahead of the point of departure of the web from the drying cylinder. According to another embodiment of the invention, the front surface is located within an angular range extending from 30° after the forward end of the area of contact of the traveling covering cloth and the running web to 25° ahead of the point of departure of the covering cloth from the web.

In the angular values according to these embodiments are different, it is preferable to select the lower values in each case. In particular, according to a preferred embodiment of the invention, the front surface 7.1 is located within an angular range extending from the smaller of (a) 45° after the forward end of the area of contact of the running web and the drying cylinder, and (b) 30° after the forward end of the area of contact of the traveling covering cloth and the running web, to the smaller of (c) 30° ahead of the point of departure of the web from the drying cylinder, and (d) 25° ahead of the point of departure of the covering cloth from the web.

In practice, it has been determined as most favorable if one or more of the subject turbulence-producing strips, baffleplates or front surfaces are located somewhere within the angular ranges defined above.

A particular advantageous further embodiment of the subject invention is obtained if the baffleplate or front surface is differentiated over the width of the machine or provided with a varying configuration across or transversely to the covering cloth 3. Through such a varying or changing profile of the external baffleplates 7, structured over the width of the drying machine or cylinder, a correction of the transverse humidity profile may be achieved. This effectively overcomes a frequently observed problem caused in praxis by the fact that the web 2 to be dried does not possess a uniform humidity content across its width. According to the currently discussed embodiment of the invention, the humidity profile of the web 2 is rendered uniform by a local control of the humidity removal corresponding to differences in the initial humidity profile across the web to be dried.

Figure 4:
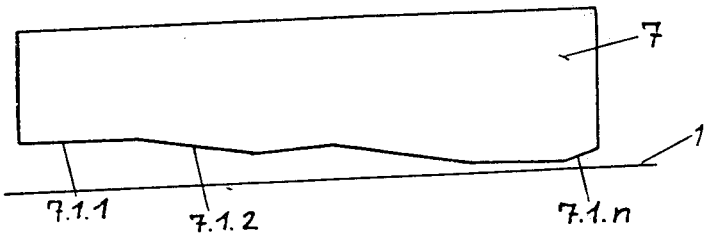
FIG. 4 is a frontal view of an improved baffleplate according to a preferred embodiment of the invention.

In this connection, FIG. 4 shows a baffleplate 7 in a view transversely of the drying cylinder 1. In particular, FIG. 4 shows baffleplate 7 with a differentiated front surface or leading edge 7.1 having a varying configuration across the drying cylinder 1 or covering cloth 3 providing different distances between the baffleplate leading edge and the covering cloth at different segments across the covering cloth (omitted in the showing of FIG. 4). In particular, the baffleplate or front surface 7.1 is differentially formed with segments 7.1.1, 7.1.2 and **7.1.*n* of such length and configuration as desired or necessary for an additional correction of the humidity transverse profile of the web 2 being dried. As shown in FIG. 4, at least part of the baffleplate or front surface may be omitted above predetermined portions of the covering cloth or drum 1. As seen at 7.1.1, the baffleplate or front surface may be recessed to such an extent that it is practically ineffective at the particular location, or part of the baffleplate may be omitted altogether, so that no increased air or humidity removal occurs at the particular point, but selectively occurs at other locations laterally of that point by action of segments 7.12 and 7.1.*n***.

Figure 5:
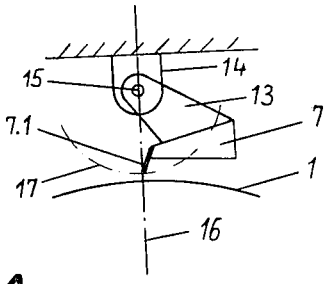
FIG. 5 is a side view of a baffleplate suspension according to an embodiment of the invention.

Accordng to a further embodiment of the invention, the baffleplate or strip 7 may be suspended in a swiveling condition. In particular and as seen in FIG. 5, the baffleplate or front surface 7.1 may be pivotally mounted or suspended about a pivot point 15 being at least approximately located on an extension of a straight line 16 through the center of the drying cylinder 1 and a leading edge of the front surface 7.1. In this manner, the baffleplate may be swung away from the drying cylinder or covering cloth in case of malfunction or otherwise, whereby damage to the covering cloth and drying cylinder is avoided. A further advantage of such swivel suspension resides in the ease and rapidity in which the covering cloth may be changed.

According to FIG. 5, the pivot 15 may be located on a suspension bracket 14 which is linked to an arm or carrier 13 of the baffleplate suspension, with the center of gravity perferably being at least approximately located on an extension of line 16 defined above.

The subject extensive disclosure suggests or renders apparent to those skilled in the art various modifications and variations within the spirit and scope of the subject invention.

I claim:

1. In a method of drying a web of material running between a drying cylinder and a traveling covering cloth tending to form an air boundary layer impeding heat exchange and humidity removal, the improvement comprising in combination the steps of:

avoiding excessive wear of the covering cloth by locating a baffleplate at a distance from the covering cloth within a domain of the boundary layer;

promoting a heat exchange and humidity removal through turbulence by impacting air from the boundary layer against a front surface of the baffleplate at a distance from the covering cloth, causing an exchange of air in the boundary layer and in meshes of the covering cloth, and providing the front surface with a varying configuration across the covering cloth.

2. A method as claimed in claim 1, including the step of:

omitting at least part of the front surface above predetermined portions of the covering cloth.

3. A method as claimed in claim 1 or 2, including the step of:

pivotally mounting the baffleplate about a pivot point being at least approximately located on an extension of a straight line through the center of the drying cylinder and a leading edge of the front surface.

4. A method as claimed in claim 1 or 2, including the step of:

locating said front surface within an angular range extending from 45° after the forward end of the area of contact of the running web and the drying cylinder to 30° ahead of the point of departure of the web from the drying cylinder.

5. A method as claimed in claim 1 or 2, including the step of:

locating said front surface within an angular range extending from 30° after the forward end of the area of contact of the traveling covering cloth and the running web to 25° ahead of the point of departure of the covering cloth from the web.

6. A method as claimed in claim 1 or 2, including the step of:

locating said front surface within an angular range extending from the smaller of (a) 45° after the forward end of the area of contact of the running web and the drying cylinder, and (b) 30° after the forward end of the area of contact of the traveling covering cloth and the running web, to the smaller of (c) 30° ahead of the point of departure of the web from the drying cylinder, and (d) 25° ahead of the point of departure of the covering cloth from the web.

7. In apparatus for drying a web of material running between a drying cylinder and a traveling covering cloth tending to form an air boundary layer impeding heat exchange and humidity removal, the improvement comprising in combination:

a baffleplate having a front surface with a varying configuration across the covering cloth;

means for locating said baffleplate at a distance from the covering cloth within a domain of the boundary layer and for impacting air from the boundary layer against said front surface of the baffleplate at a distance from the covering cloth, causing an exchange of air in the boundary layer and in meshes of the covering cloth.

8. Apparatus as claimed in claim 7, wherein:

at least part of the front surface is lacking above predetermined portions of the covering cloth.

9. Apparatus as claimed in claim 7 or 8, including:

means for pivotally mounting the baffleplate about a pivot point being at least approximately located on an extension of a straight line through the center of the drying cylinder and a leading edge of the front surface.

10. Apparatus as claimed in claim 7 or 8, wherein:

said front surface is located within an angular range extending from 45° after the forward end of the area of contact of the running web and the drying cylinder to 30° ahead of the point of departure of the web from the drying cylinder.

11. Apparatus as claimed in claim 7 or 8, wherein:

said front surface is located within an angular range extending from 30° after the forward end of the area of contact of the traveling covering cloth and the running web to 25° ahead of the point of departure of the covering cloth from the web.

12. Apparatus as claimed in claim 7 or 8, wherein:

said front surface is located within an angular range extending from the smaller of (a) 45° after the forward end of the area of contact of the running web and the drying cylinder, and (b) 30° after the forward end of the area of contact of the traveling covering cloth and the running web, to the smaller of (c) 30° ahead of the point of departure of the web from the drying cylinder, and (d) 25° ahead of the point of departure of the covering cloth from the web.

13. In a method of drying a web of material running between a drying cylinder and a traveling covering cloth tending to form an air boundary layer impeding heat exchange and humidity removal, the improvement comprising in combination the steps of:

avoiding excessive wear of the covering cloth by providing a baffleplate having a leadind edge spaced from the covering cloth within a domain of the boundary layer;

promoting a heat exchange and humidity removal through turbulence by impacting air from the boundary layer against a front surface of the baffleplate at a distance from the covering cloth, causing an exchange of air in the boundary layer and in meshes of the covering cloth; and correcting effects of non-uniform humidity profiles across the web by providing different distances between said leading edge of the baffleplate and the covering cloth at different segments across the covering cloth.

14. In apparatus for drying a web of material running between a drying cylinder and a traveling covering cloth tending to form an air boundary layer impeding heat exchange and humidity removal, the improvement comprising in combination:

means for locating a baffleplate having a leading edge spaced from the covering cloth within a domain of the boundary layer and for impacting air from the boundary layer against a front surface of the baffleplate at a distance from the covering cloth, causing an exchange of air in the boundary layer and in meshes of the covering cloth;

said leading edge of the baffleplate being spaced at different distances from said covering cloth in different segments across the covering cloth.

* * * * *